US010347229B2

(12) United States Patent
Nakamura

(10) Patent No.: US 10,347,229 B2
(45) Date of Patent: Jul. 9, 2019

(54) ELECTRONIC MUSICAL INSTRUMENT, METHOD OF CONTROLLING THE ELECTRONIC MUSICAL INSTRUMENT, AND RECORDING MEDIUM

(71) Applicant: CASIO COMPUTER CO., LTD., Shibuya-ku, Tokyo (JP)

(72) Inventor: Atsushi Nakamura, Akishima (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 15/921,484

(22) Filed: Mar. 14, 2018

(65) Prior Publication Data

US 2018/0277077 A1 Sep. 27, 2018

(30) Foreign Application Priority Data

Mar. 24, 2017 (JP) ..... 2017-058581

(51) Int. Cl.
*G10H 1/00* (2006.01)
*G10H 1/36* (2006.01)
(Continued)

(52) U.S. Cl.
CPC ..... *G10H 1/0016* (2013.01); *G10H 1/344* (2013.01); *G10H 1/38* (2013.01); *G10H 1/40* (2013.01);
(Continued)

(58) Field of Classification Search
CPC ..... G10H 2210/066; G10H 2220/015; G10H 1/26; G10H 1/0016; G10H 2210/081; G10H 2220/221
See application file for complete search history.

(56) References Cited

U.S. PATENT DOCUMENTS

2001/0029829 A1* 10/2001 Moe ..... G09B 15/08 84/478
2002/0017187 A1* 2/2002 Takahashi ..... G09B 15/023 84/478
(Continued)

FOREIGN PATENT DOCUMENTS

JP 58192070 A 11/1983
JP 59195690 A 11/1984
(Continued)

OTHER PUBLICATIONS

Japanese Office Action (and English language translation thereof) dated May 22, 2018 issued in Japanese Application No. 2017-058581.

*Primary Examiner* — Marlon T Fletcher
(74) *Attorney, Agent, or Firm* — Holtz, Holtz & Volek PC

(57) ABSTRACT

An electronic musical instrument allows a player to operate operators as least number of times as possible to play music, and the player can play music easily and agreeably, using the instrument. Every measure decided by plural beats counted based on a designated meter a prior tone is determined from among automatic playing music data. The prior tone is a musical tone which is made note-on for example at a timing of a downbeat in the measure. If a candidate for the prior tone is one of chord composing tones, and the one of chord composing tones can compose a melody, then such musical tone is decided as the prior tone. The prior tones successively decided from the beginning of the automatic playing music data are indicated to the player as lighted up keys. The player operates the lighted up keys successively to perform the automatic playing music data.

12 Claims, 10 Drawing Sheets

(51) Int. Cl.

| | |
|---|---|
| ***G10H 1/38*** | (2006.01) |
| ***G10H 1/34*** | (2006.01) |
| ***G10H 1/40*** | (2006.01) |

(52) U.S. Cl.

CPC . *G10H 2210/005* (2013.01); *G10H 2210/066* (2013.01); *G10H 2210/071* (2013.01); *G10H 2210/341* (2013.01); *G10H 2210/385* (2013.01); *G10H 2220/061* (2013.01)

(56) References Cited

U.S. PATENT DOCUMENTS

| | | | | |
|---|---|---|---|---|
| 2011/0283867 | A1* | 11/2011 | Ihara | G09B 15/08 84/478 |
| 2013/0298750 | A1* | 11/2013 | Kira | G10H 1/26 84/613 |

FOREIGN PATENT DOCUMENTS

| | | | |
|---|---|---|---|
| JP | 05181460 | A | 7/1993 |
| JP | 10240244 | A | 9/1998 |
| JP | 2006058384 | A | 3/2006 |
| JP | 2010190942 | A | 9/2010 |

* cited by examiner

FIG.3

| | | | |
|---|---|---|---|
| HEADER CHUNK | | ChunkID | FIXED LETTER STRING "MThd"=0x4d546864 |
| | | ChunkSize | LENGTH OF HEADER CHUNK=0x00000006 |
| | | FormatType | FORMAT, FOR EXAMPLE 0x0001 |
| | | NumberOfTrack | THE NUMBER OF TRACKS, FOR EXAMPLE 0x0002 |
| | | TimeDivision | TIME BASE, FOR EXAMPLE 0x1e0 |
| TRACK CHUNK 1 (RIGHT HAND PART) | AutoNote[0] | ChunkID | FIXED LETTER STRING "MTrk"=0x4d54726b |
| | | ChunkSize | LENGTH OF TRACK CHUNK 1 |
| | DeltaTime[0] | DeltaTime | WAITING TIME FROM LAST EVENT |
| | Event[0] | Event | EVENT |
| | DeltaTime[1] | DeltaTime | WAITING TIME FROM LAST EVENT |
| | Event[1] | Event | EVENT |
| | ... | ... | |
| | DeltaTime[L-1] | DeltaTime | WAITING TIME FROM LAST EVENT |
| | Event[L-1] | Event | END OF TRACK [End of Track] |
| TRACK CHUNK 2 (LEFT HAND PART) | | ChunkID | FIXED LETTER STRING "MTrk"=0x4d54726b |
| | | ChunkSize | LENGTH OF TRACK CHUNK 2 |
| | DeltaTime[0] | DeltaTime | WAITING TIME FROM LAST EVENT |
| | Event[0] | Event | EVENT |
| | DeltaTime[1] | DeltaTime | WAITING TIME FROM LAST EVENT |
| | Event[1] | Event | EVENT |
| | ... | ... | |
| | DeltaTime[M-1] | DeltaTime | WAITING TIME FROM LAST EVENT |
| | Event[M-1] | Event | END OF TRACK [End of Track] |

FIG.4

| | | |
|---|---|---|
| LightNote[0] | LightOnTime | LIGHT UP TIME |
| | LightOnKey | KEY NUMBER |
| LightNote[1] | LightOnTime | |
| | LightOnKey | |
| | ... | |
| LightNote[N-1] | LightOnTime | |
| | LightOnKey | |

ELECTRONIC MUSICAL INSTRUMENT, METHOD OF CONTROLLING THE ELECTRONIC MUSICAL INSTRUMENT, AND RECORDING MEDIUM

CROSS-REFERENCE TO RELATED APPLICATION

The present application is based upon and claims the benefit of priority from the prior Japanese Patent Application No. 2017-058581, filed Mar. 24, 2017, the entire contents of which are incorporated herein by reference.

BACKGROUND OF THE INVENTION

1. Field of the Invention

The present invention relates to an electronic musical instrument, a method of controlling the electronic musical instrument, and a recording medium.

2. Description of the Related Art

An electronic keyboard instrument is known, a key of whose keyboard to be operated by a player is lighted up in synchronism with advance of an automatic performance. This kind of keyboard instrument is used to enhance playing the musical instrument.

For allowing a beginner to do practice of playing the musical instrument in an easy manner, a conventional technique of an electronic musical instrument with the keyboard to be lighted up is known, which instrument reproduces a melody even when any key is pressed as far as a timing when a key of the keyboard is pressed meets with a time when the melody stored in the instrument is output.

For a professional practice of playing the musical keyboard instrument, a technique of an electronic musical instrument with the keyboard to be lighted up is known, in which all the keys to be pressed successively are lighted up in accordance with advance of a melody and when these lighted up keys are pressed, the melody is reproduced.

The conventional technique of an electronic musical instrument with a keyboard key to be lighted up, which reproduces a melody as far as a key is pressed good timing can be too easy for a practice of playing a musical instrument.

On the contrary, the conventional technique of an electronic musical instrument with a keyboard key to be lighted up, which reproduces a melody as far as a correct key is pressed will be too easy for a practice of playing the musical instrument.

The present invention provides an apparatus, which allows the player to reduce the number of times of designating an operator of the apparatus as least as possible, when he/she plays music, and to enjoy playing the music easily.

SUMMARY OF THE INVENTION

According to one aspect of the present invention, there is provided an electronic musical instrument which comprises plural operators that specify different pitches of a musical tone indicated by music data, respectively, wherein the music data has plural sections containing at least a first section of a time length and a second section of a time length, the second section following the first section; and plural pitches are included in both of the first section and the second section, and a processor that executes the followings:

displaying an identifier for identifying one pitch among the plural pitches included in the first section, allowing a player to operate the operator corresponding to the pitch identified in the first section by the identifier; and playing back a musical tone corresponding to the pitch identified in the first section in response to the operation of the operator by the player, up to a pitch among the plural pitches included in the second section, whereby the processor executes an automatic playing back of the music data.

In the electronic musical instrument, the section includes at least one section duration of one meter, and it is possible to make a section duration of the first section and a section duration of the second section equivalent to each other or different from other. For instance, the section duration of the first section can be set to a section duration of one or plural meters, or can be set to a section duration of one or plural measures, or can be set to any length.

The processor decides a prior tone in each section to allow the player to designate the aforesaid prior tone.

The processor decides a pitch as the prior tone at a timing of a downbeat in each section to allow the player to designate the aforesaid prior tone.

When the section duration of the first section and the section duration of the second section are set equivalent, and the player is allowed to designate the operator at the same timing (at a constant rhythm), the player will be enjoy playing the musical instrument in more simple manner.

When syncopation is generated at the timing of the downbeat in some section, the processor decides a last tone in a section before the some section as the prior tone in the some section as the prior tone in the some section.

The processor specifies chord composing tones based on music data of the music. When the chord composing tones have been specified, the processor decides as the prior tone one tone having a tone duration different from other among the specified chord composing tones. Meanwhile, when the chord composing tones have not been specified, the processor decides a tone having a highest pitch in the section as the prior tone.

When the electronic musical instrument is a keyboard instrument, the plural operators are composed of plural white keys and black keys of a keyboard, and the processor makes either key of the white keys and the black keys of the keyboard lighted up.

In the automatic playing back of the music data, the processor outputs voices in accordance with lyrics of the music.

According to another aspect of the invention, there is provided an electronic musical instrument which comprises plural operators that specify different pitches of a musical tone indicated in music data, respectively, wherein the music data has plural sections containing at least a first section and a second section which follows the first section; and plural pitches are included in both of the first section and the second section; and a processor which executes following processes: displaying a prior tone of the first section indicated by one pitch among plural pitches contained in the first section, thereby allowing a player to designate the aforesaid prior tone; and playing back a musical tone of the pitch corresponding to the prior tone of the first section every time either of the plural operators is designated by the player; and keeping the musical tone sounding up to a tone before a prior tone of the second section indicated by one pitch among plural pitches contained in the second section, whereby the processor executes an automatic playing back of the music data.

BRIEF DESCRIPTION OF THE DRAWINGS

The accompanying drawings, which are incorporated in and constitute a part of the specification, illustrate embodiments of the invention, and together with the general description given above and the detailed description of the embodiments given below, serve to explain the principles of the invention for better understanding of the invention.

FIG. 3 is a view showing an example of a configuration of automatic playing music data.

FIG. 4 is a view showing an example of a data configuration of key light-up controlling data.

DETAILED DESCRIPTION OF THE PREFERRED EMBODIMENTS

Figure 1:
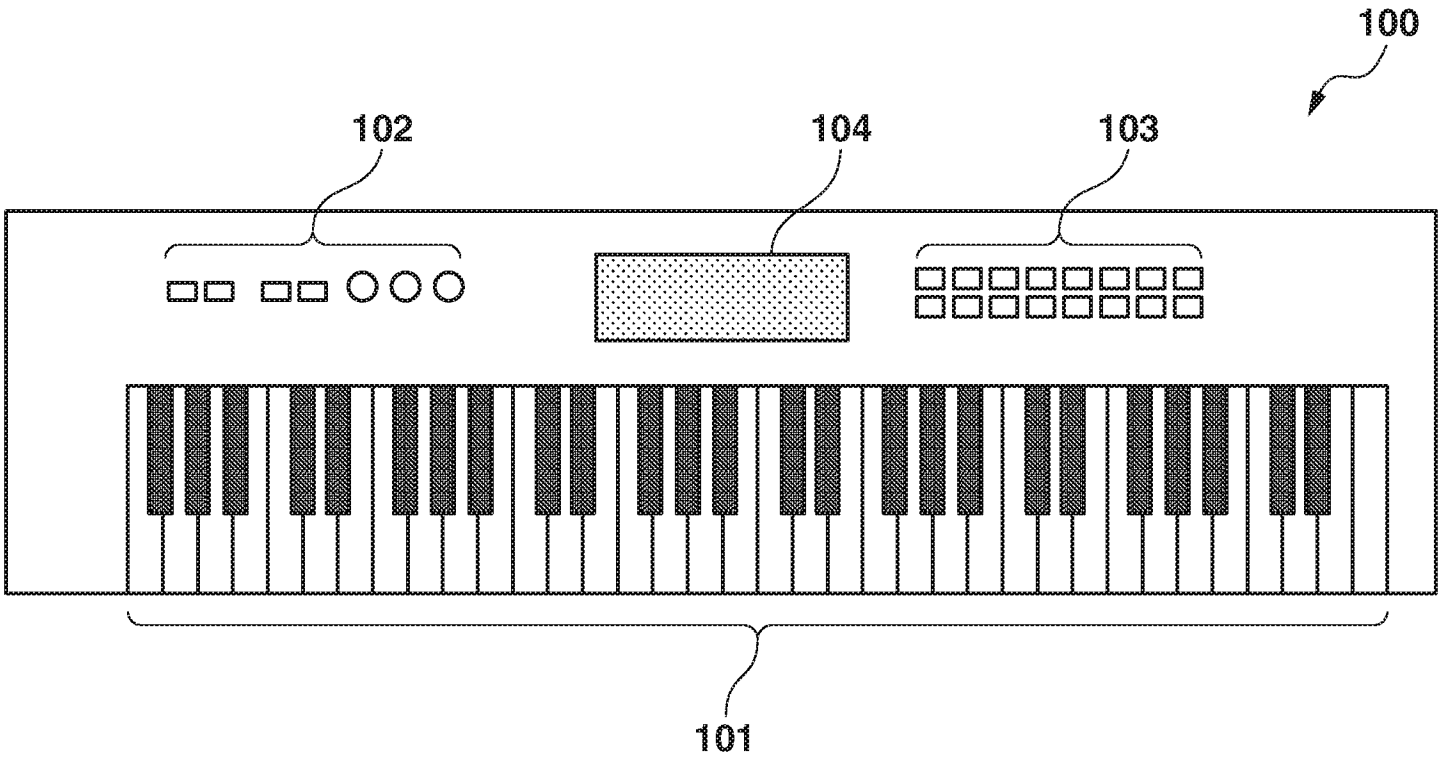
FIG. 1 is a view showing an example of an external view of an electronic keyboard instrument according to the present embodiment of the invention.

Now, the embodiments of the present invention will be described with reference to the accompanying drawings in detail. In the present embodiment, music data to be played automatically (hereinafter, referred to as "automatic playing music data") is divided into plural sections having a predetermined duration, for instance, plural measures defined based on plural number of beats (for instance, 4 beats or 3 beats) of the automatic playing music data. A prior tone is decided in each of the sections or the measures from the automatic playing music data. The prior tone is a tone which is indicated by at least one musical note among plural musical notes contained in each section such as a measure and/or a beat. For instance, the prior tone is a musical tone which is made note-on by the automatic playing music data at a timing of a downbeat (including a medium beat or a middle beat between a downbeat and an upbeat) in the measure. It is possible to include in the prior tone a musical tone which will be made note-on at a timing of an upbeat in the measure. When a candidate for the prior tone is included in chord component tones, for instance, one musical tone of the chord component tones which can compose a melody will be decided as the prior tone. In the present embodiment, the decided prior tones are successively indicated to a player from the beginning of the automatic playing music data as a luminous or lighted up key of the keyboard, and every time the player presses the lighted up or luminous key to play the indicated prior tone, the automatic playing music data is automatically played up to a prior tone next to the indicated prior tone. But the prior tone is not always the beginning tone in the measure or the beat. When the player plays music, it will be good that the player is made to designate at least one musical note among plural musical notes included in each section such as a measure and/or a beat, whereby the player is allowed to designate operators as less times of operations as possible.

When the player presses a luminous or lighted up key indicating a prior tone, a key indicating the next prior tone becomes luminous and the automatic performance advances up to the tone just before the next prior tone indicated by said key and temporarily suspends until the player presses the luminous or lighted up key indicating the next prior tone. When the player presses the luminous or lighted up key indicating the next prior key in synchronism with the key lighting, the key indicating the next prior tone will become luminous and the automatic performance will advance up to the next prior tone. Therefore, it will be possible for the player to do a practice of a lesson without effort, while following the key which will become luminous or lighted up in the synchronism with, for instance, the downbeat and/or the medium beat in each measure, which beat has an important meaning in music (the first beat and the second beat in a quadruple meter, and the first beat in a triple meter).

Further, in the present embodiment, a singing voice to accompaniment of an automatic performance of the automatic playing music data is output for instance based on word data prepared in association with the automatic playing music data, while being subjected to voice synthesis with pitches and tone durations corresponding to the performance. In this case, when the player presses the luminous or lighted up key indicating the prior tone, the singing will advance, meanwhile a key which indicates the next prior tone will become luminous or lighted up and the automatic performance of an electronic musical instrument will advance up to the tone just before the next prior tone.

In this fashion, the player is allowed to give a performance, while enjoying the singing.

FIG. 1 is a view showing an example of an external view of an electronic keyboard instrument 100 according to the present embodiment of the invention. The electronic keyboard instrument 100 is provided with a keyboard 101, a first switch panel 102, a second switch panel 103, and an LCD (liquid Crystal Display) 104.

The keyboard 101 has plural keys or playing operators each having a function of becoming luminous or being lighted up.

The first switch panel 102 is used to give various instructions such as an instruction of setting a sound volume and a tempo of the automatic performance and an instruction of starting the automatic performance. The LCD displays song lyrics and various setting conditions while an automatic performance is being performed. The electronic keyboard instrument 100 has a speaker (not shown) installed on a rear or side portion of the instrument, from which music is output.

Figure 2:
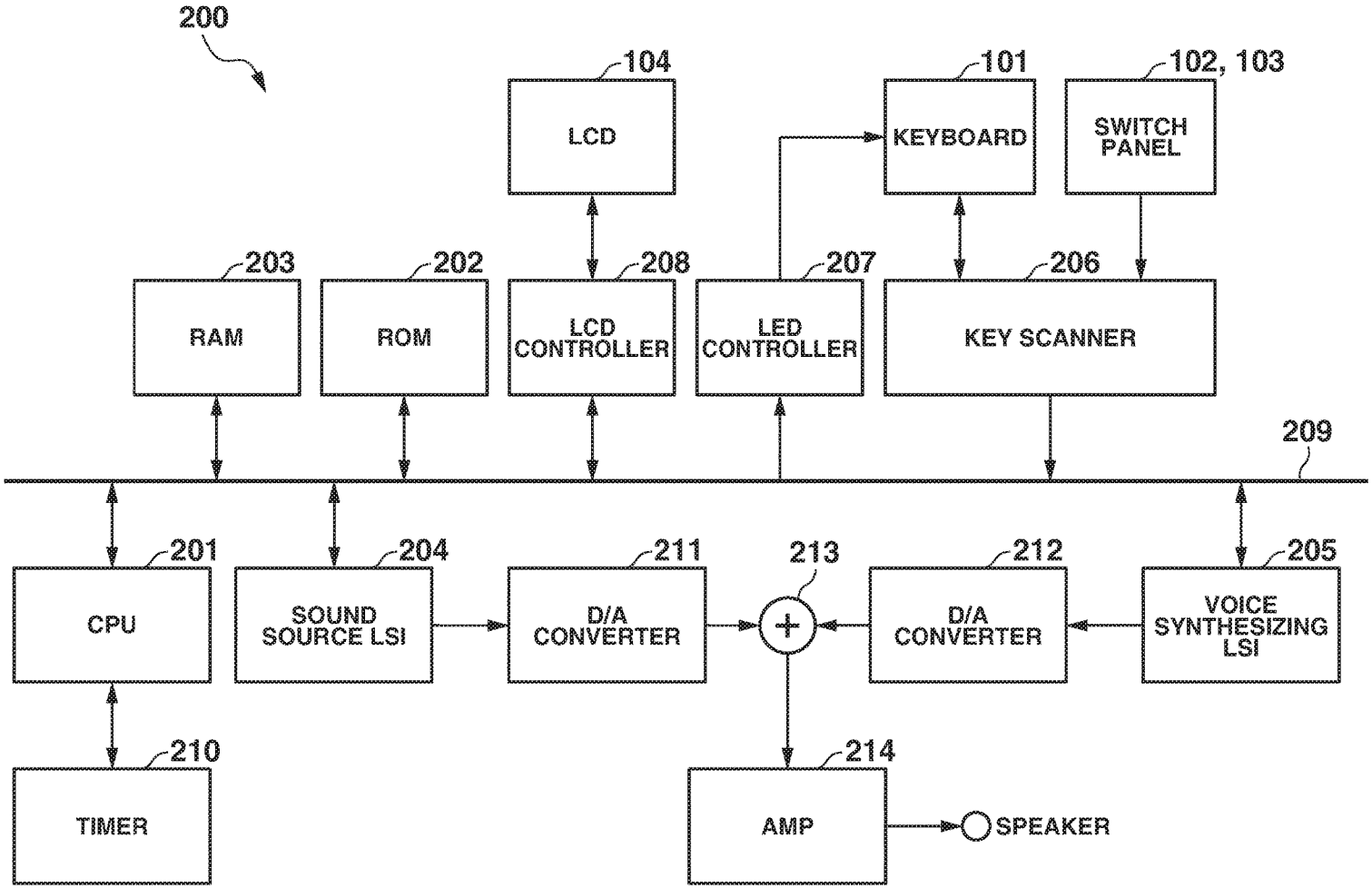
FIG. 2 is a block diagram showing an example of a hardware configuration of a controlling system of the electronic keyboard instrument shown in FIG. 1.

FIG. 2 is a block diagram showing an example of a hardware configuration of a controlling system 200 of the electronic keyboard instrument 100 shown in FIG. 1.

As shown in FIG. 2, the controlling system 200 comprises CPU (Central Processing Unit) 201, ROM (Read Only Memory) 202, RAM (Random Access Memory) 203, a sound source LSI (Large Scale Integrated Circuit) 204, a voice synthesizing LSI 205, the keyboard 101, the first switch panel 102, the second switch panel 103 (these three elements are shown in FIG. 1), a key scanner 206 connected to the keyboard 101, the first switch panel 102 and the second switch panel 103, an LED controller 207 which controls each of LEDs to light up the corresponding key of the keyboard 101 (FIG. 1), and an LED controller 208 connected to the LCD 104 (FIG. 1). All of these elements are connected to each other through a system bus 209. A timer 210 for controlling a sequence of the automatic performance is connected to the CPU 201.

Further, digital music waveform data and digital voice data are output from the sound source LSI (Large Scale Integrated Circuit) 204 and the voice synthesizing LSI 205 respectively and further supplied to D/A converters 211 and 212. The converted music data and voice data are further converted into an analog music waveform signal and an analog voice signal, respectively. The analog music waveform signal and the analog voice signal are supplied to a mixer 213 to be mixed together into a mixed signal. The mixed signal is amplified in an amplifier 214 and supplied to an output terminal (not shown) or output through a speaker (not shown).

The CPU 201 uses the RAM 203 as a work memory to execute a control program stored in the ROM 202, thereby executing a controlling operation of the electronic keyboard instrument 100 (shown in FIG. 1). The ROM 202 stores various data and the automatic playing musical data in addition to the control program.

The timer 210 is installed on the CPU 201 and counts a progress of the automatic performance of the electronic keyboard instrument 100.

The sound source LSI 204 reads music waveform data from a waveform ROM (not shown) and supplies the data to the D/A converter 211. The sound source LSI 204 has a capacity of generating 256 voices simultaneously.

Upon receipt of text data of song lyrics and pitch and duration data from the CPU 201, the voice synthesizing LSI 205 synthesizes the text data and the voice data to the digital voice data and supplies the digital voice data to the D/A converter 212.

The key scanner 206 scans the keyboard 101, the first switch panel 102 and the second switch panel 103 to detect a pressed key and/or a released key and switching operation performed on the panels 102 and 103, and interrupts the operation of the CPU 101 to give the detecting results.

The LED controller 207 makes the key of the keyboard 101 luminous or lights up the key in response to the instruction from the CPU 201, thereby navigating the performance by the player.

The LED controller 208 controls an image displayed on the LCD 104.

The operation of the electronic keyboard instrument 100 (FIG. 1) having the configuration shown in FIG. 2 will be described in detail.

FIG. 3 is a view showing an example of a configuration of the automatic playing music data which is read from the ROM 2202 onto the RAM 203. This data configuration conforms to a format of the standard MIDI (Musical Instrument Digital Interface) file which is one of the MIDI file formats. The automatic playing music data is composed of plural data blocks (sets of data or data sets) called as "chunks". More specifically, the automatic playing music data is composed of a header chunk at the leading part, a track chunk 1 for a right hand containing performance data and word data, and a track chunk 2 for a left hand containing performance data and word data.

The header chunk contains five values such as Chunk ID, Chunk Size, Format Type, Number of Track, and Time Division.

The Chunk ID is ASCII Code of 4 bytes, "4D 54 68 64" (the numeral is expressed in the hexadecimal numbering system) corresponding to 4 half-width letters "MThd", which indicates that this chunk is the header chunk.

The Chunk Size is data of 4 bytes which indicates a data length of data containing the Format Type, Number of Track, and Time Division in the header chunk, with the Chunk ID and the Chunk Size excluded. The data length is fixed to 6 bytes, "00 00 00 06" (the numeral is expressed in the hexadecimal numbering system).

The Format Type is data of 2 bytes "00 01" (the numeral is expressed in the hexadecimal numbering system) which indicates a "format 1" which uses plural tracks in the present embodiment.

The Number of Track is data of 2 bytes "00 02" (the numeral is expressed in the hexadecimal numbering system) which indicates that 2 tracks are used for the right hand part and the left hand part in the present embodiment.

The Time Division is data which expresses a time base value for indicating a resolution per quarter note and is given by 2-bytes data "01 E0" expressing a number "480" in the decimal numbering system in the present embodiment.

As shown in FIG. 3, the Track Chunk 1 (the right hand part) is composed of a performance data set containing the Chunk ID, Chunk Size and Delta Time [i] and Event [i] ($0 \le i \le L$). The Track Chunk 2 (left hand part) is composed of a performance data set containing the Chunk ID, Chunk Size and Delta Time [i] and Event [i] ($0 \le i \le M$).

The Chunk ID is given by ASCII Code of 4 bytes "4D 54 72 6B" (the numeral is expressed in the hexadecimal numbering system) corresponding to 4 half-width letters "MTrk", which indicates that this chunk is a track chunk.

The Chunk Size is data of 4 bytes which indicates a data length of each track chunk excluding the Chunk ID and the Chunk Size.

The Delta Time [i] is data having a variable length of 1 to 4 bytes indicating a waiting time after performing the last Event [i−1].

The Event [i] is a command of instructing the electronic keyboard instrument 100 to execute a performance. The Event [i] contains MIDI event which gives instructions such as "Note-on", "Note-off", and/or "changing tone color", and Meta event designating lyrics data or a rhythm.

In each performance data set, the Delta Time [i] or the Event [i], the Event [i] will be executed when the duration of the Delta Time [i] passes after the time when the Event [i−1] was executed, whereby the automatic performance is executed.

FIG. 4 is a view showing an example of a data configuration of the key light-up controlling data generated on the RAM 201 shown in FIG. 2.

The key light-up controlling data is controlling data used to make the LED light up the corresponding key of the keyboard 101 (FIG. 1) or to make the key of the keyboard 101 luminous. The key light-up controlling data set for one automatic playing music is composed of "N" pieces of data sets, Light Note [0] to Light Note [N−1] ("N" is a natural number not less than 1). One key light-up controlling data set Light Note [i] ($0 \le i \le N-1$) has two values Light On Time and Light On Key.

The Light On Time is data indicating a time duration passed after the time when the key was lit up to start the automatic performance.

The Light On Key is data indicating the number of the key which is to be lit up.

Figure 5:
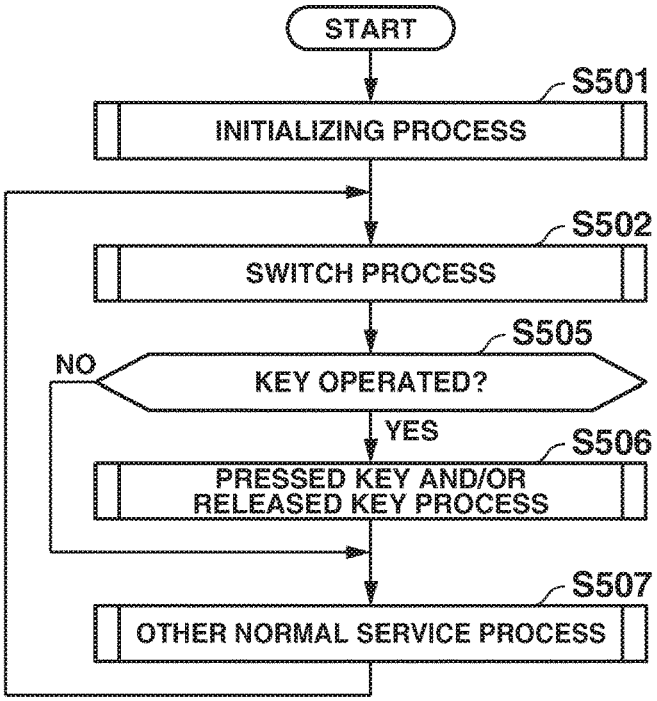
FIG. 5 is a flow chart of an example of controlling operation of the electronic keyboard instrument according to the embodiment of the invention.

FIG. 5 is a flow chart of an example of controlling operation of the electronic keyboard instrument according to the embodiment of the invention. The CPU 201 (FIG. 2) reads and executes the control program stored in the ROM 202 to perform the controlling operation.

The CPU 201 performs an initializing process at step S501 and then repeatedly performs a series of processes at steps S502 to S507.

The CPU 201 performs a switch process at step S502. When operation is interrupted by the key scanner 206 (FIG. 2), the CPU 201 performs processes in response to switching operations executed on the first switch panel 102 and the second switch panel 103 (FIG. 1).

Further, when operation is interrupted by the key scanner 206 (FIG. 2) (step S502), the CPU 201 judges whether any key of the keyboard 101 (FIG. 1) has been operated (step S505). When it is determined YES at step S505, the CPU 201 performs a pressed and/or released key process (step S506). In the pressed and/or released key process, the CPU 201 gives the sound source LSI 204 an instruction of starting generation of a tone or an instruction of stopping generation of a tone in response to a key pressing operation or a key releasing operation by the player, respectively. Further, the CPU 201 judges whether the key lit up at present has been pressed by the player and executes the related process. When it is determined NO at step S505, the CPU 201 skips over the process at step S506.

At step S507, the CPU 201 performs other normal service process including an envelope control process on a musical tone generated from the sound source LSI 204.

Figure 6:
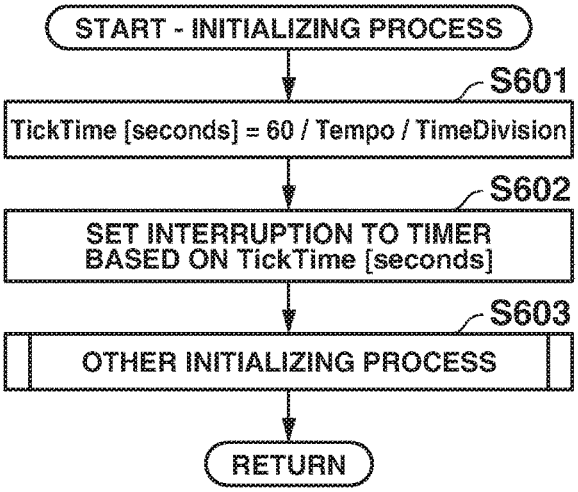
FIG. 6 is a flow chart of an example of a detailed initializing process.

FIG. 6 is a flow chart of an example of the detailed initializing process at step S501 in FIG. 5.

The CPU 201 performs the initializing process on a Tick Time particularly specialized in the present embodiment of the invention. In the present embodiment, the automatic performance progresses in unit of time "Tick Time". A value of time base designated as a value of the Time Division in the header chunk of the automatic playing music data (FIG. 3) indicates the resolution of the quarter note. If the value of time base is 480, this means that the quarter note has a duration of 480 Tick Time. The waiting time Delta Time [i] in the track chunk in the automatic playing music data (FIG. 3) is also counted in unit of time "Tick Time". In practice, it will be variable depending on the tempo designated for the automatic playing music data, how many number of seconds "1 Tick Time" corresponds to. Assuming that a value of the tempo is Tempo [beat/minute] and a value of the time base is Time Division, Tick Time (seconds) will be given by the following formula.

$$\text{Tick Time(seconds)}=60/\text{Tempo}/\text{Time Division} \quad (1)$$

In the initializing process shown in FIG. 6, the CPU 201 calculates the formula (1) to obtain Tick Time (seconds) (step S601). It is assumed that the initial value of the Tempo, for instance, 60 (beats/sec.) is stored in the ROM 202, or the last tempo value is stored in a non-volatile memory.

The CPU 201 sets a timer interruption to the timer 210 (FIG. 2) based on the Tick Time (second) calculated at step S601 (step S602). As a result, every time when the Tick Time (seconds) has elapsed in the timer 210, an interruption to the automatic performance (hereinafter, referred to as "automatic performance interruption") is made in the operation of the CPU 201. In the automatic performance interruption, the CPU 201 performs a controlling process every 1 Tick Time to make the automatic performance advance, as will be described with reference to FIG. 13 in detail.

Further, the CPU 201 performs other initializing process including an initializing process of the RAM 203 (FIG. 2) (step S603), finishing the initializing process (step S501) shown in FIG. 6.

Figure 7:
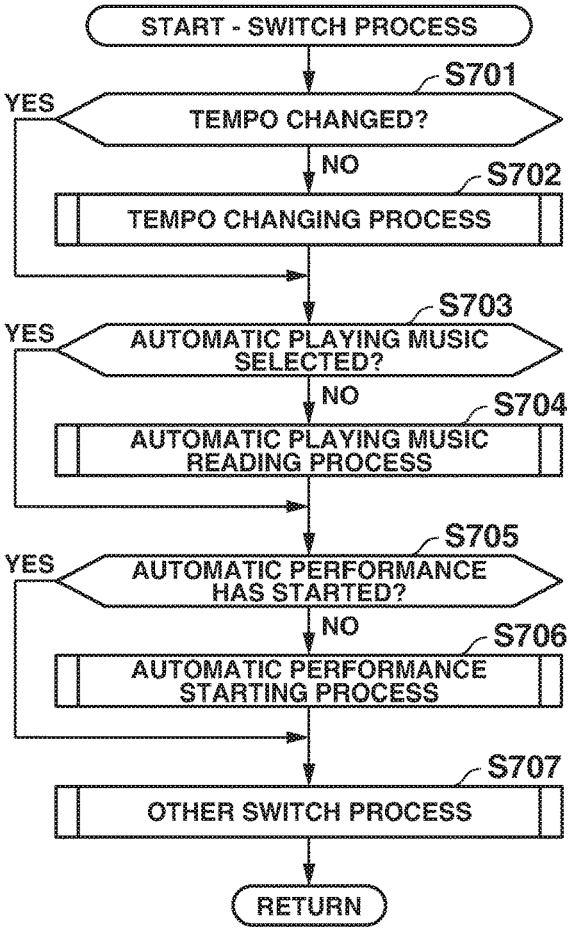
FIG. 7 is a flow chart of an example of a detailed switch process.

FIG. 7 is a flow chart of an example of the detailed switch process at step S502 in FIG. 5.

The CPU 201 judges whether a tempo changing switch of the first switch panel 102 (FIG. 1) has been operated to change the tempo of the automatic performance (step S701). When it is determined YES at step S701, the CPU 201 performs a tempo changing process (step S702). The tempo changing process will be described with reference to FIG. 8 in detail. When it is determined NO at step S701, the CPU 201 skips over the process at step S702.

Further the CPU 201 judges whether a music selecting switch on the second switch panel 103 (FIG. 1) has been operated to select either one of music for the automatic performance (step S703). When it is determined YES at step S703, the CPU 201 performs an automatic playing music reading process (step S704). The automatic playing music reading process will be described with reference to FIG. 10 in detail. When it is determined NO at step S703, the CPU 201 skips over the process at step S704.

The CPU 201 judges whether an automatic performance starting switch on the first switch panel 102 (FIG. 1) has been operated to start the automatic performance (step S705). When it is determined YES at step S705, the CPU 201 starts performing an automatic performance starting process (step S706). The automatic performance starting process will be described with reference to FIG. 11 in detail. When it is determined NO at step S705, the CPU 201 skips over the process at step S706.

Finally, the CPU 201 judges whether any switch on the first switch panel 102 (FIG. 1) or on the second switch panel 103 (FIG. 1) has been operated and performs a process corresponding to the operated switch (step S707). Then, the CPU 201 finishes the switch process at step S502 shown in FIG. 5.

Figure 8:
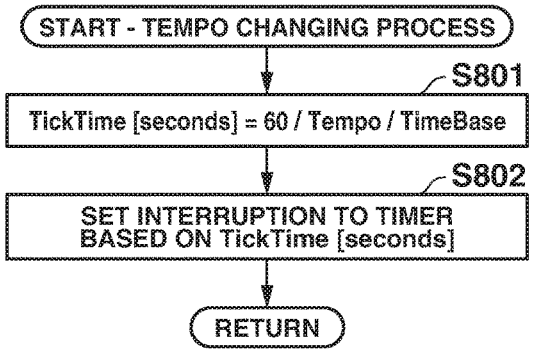
FIG. 8 is a flow chart of an example of a detailed tempo changing process.

FIG. 8 is a flow chart of an example of the detailed tempo changing process at step S702 in FIG. 7. As described above, when the tempo value is changed, the Tick Time (second) is changed too. In the flow chart of FIG. 8, the CPU 201 performs a control process to change the Tick Time (second).

Similarly to the process (step S601 in FIG. 6) performed in the initializing process at step S501 in FIG. 5, the CPU 201 operates the formula (1) to calculate the Tick Time (second) (step S801). When the tempo changing switch of the first switch panel 102 is operated and the tempo is changed, the changed tempo value is stored in the RAM 203.

Similarly to the process (step S602 in FIG. 6) performed in the initializing process at step S501 I FIG. 5, the CPU 201 sets a timer interruption of Tick Time (second) calculated at step S801 to the timer 210 (FIG. 2) (step S802). Thereafter, the CPU 201 finishes the tempo changing process (step S702 in FIG. 7).

Figure 9:
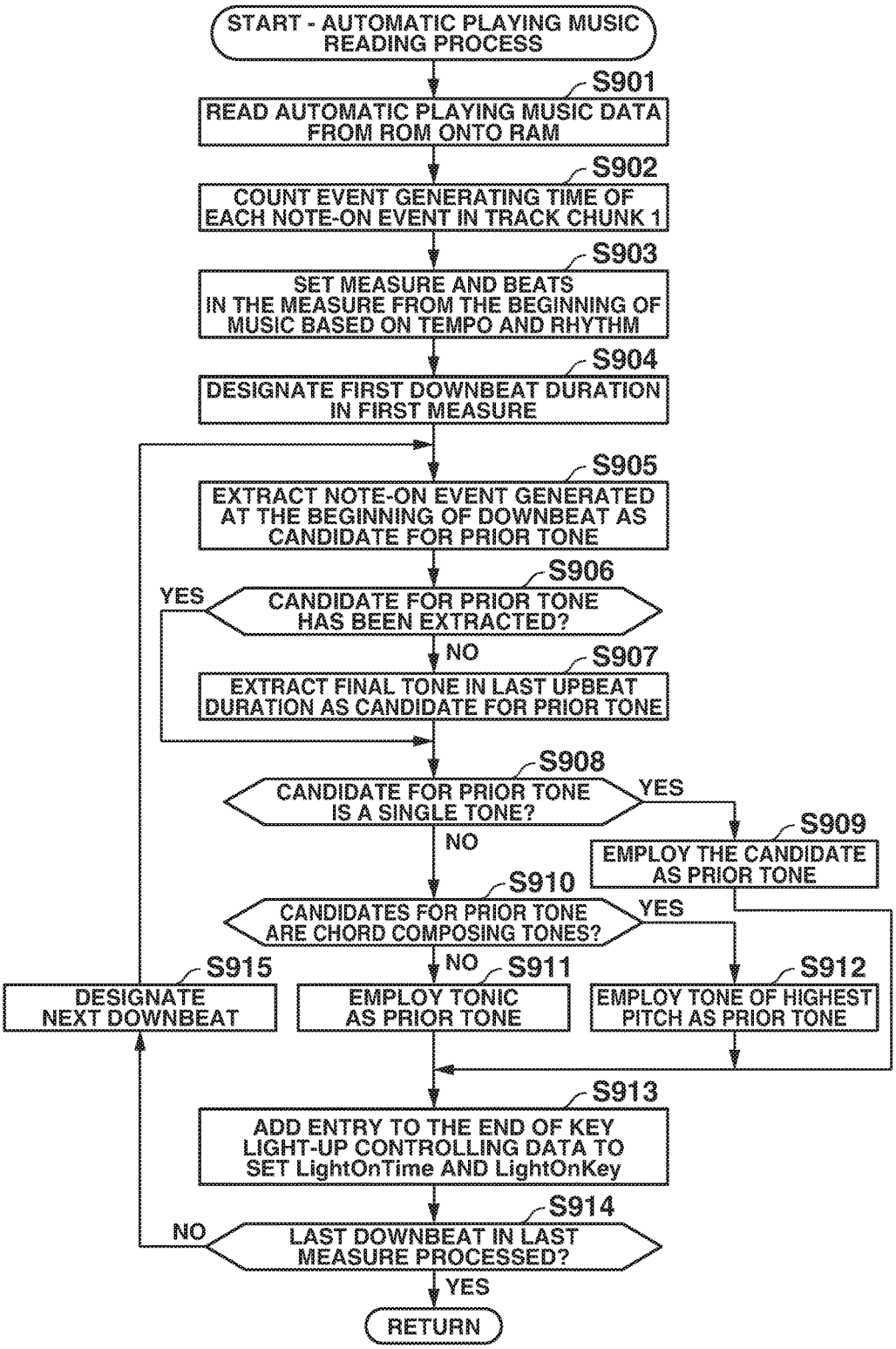
FIG. 9 is a flow chart of an example of a detailed automatic playing music reading process.

FIG. 9 is a flow chart of an example of the detailed automatic playing music reading process at step S704 in FIG. 7. In the automatic playing music reading process, the CPU 201 performs a process for reading the automatic playing music selected on the second switch panel 103 (FIG. 1) from the ROM 202 onto the RAM 203 and a process for generating key lighting control data.

The CPU 201 reads the automatic playing music of format (FIG. 2) selected on the second switch panel 103 (FIG. 1) from the ROM 202 onto the RAM 203 (step S901).

The CPU 201 executes the following processes on all the note-on events in the Event [i] ($0 \le i \le L-1$) of the track chunk 1 of the automatic playing music data read on the RAM 203 (step S901). Assuming that a note-on Event is Event [j] ($1 \le j \le L-1$), the CPU 201 accumulates waiting times Delta Time [0] to Delta Time [j] of all the Events from the beginning of the music to the note-on Event [j] to calculates an event generating time of the note-on Event [j]. The CPU 201 performs the calculation of event generating times of all the note-on Events and stores the event generating time of each note-on Event in the RAM 203 (step S902). In the present embodiment, since the keys for the right hand part are made luminous or lighted up to navigate the right hand part, it is assumed that only the track chunk 1 is subjected to the automatic playing music reading process. It is possible to select the track chunk 2, too.

Depending on the tempo value and the rhythm designated at present, the CPU 201 sets measures and beats (down beats/upbeats) within each measure from the beginning of the automatic playing music and stores information of the measures and the beats in the RAM 203 (step S903). The tempo value is an initial value or a value which is set by a tempo switch of the first switch panel 102 (FIG. 1). The rhythm is designated by the Meta event set as either of the Event [i] in the track chunk 1 of the automatic playing music data (FIG. 3). The rhythm can be changed in the middle of music. As described above, the Tick Time indicated by the time base value decides a time length expressed in unit of Tick Time of a quarter note and when the quarter note is set, 4 quarter notes compose a measure, and one Tick Time (seconds) can be calculated by the formula (1). In case of music of a quadruple meter, the first beat and the third beat in a measure are downbeats (strictly, the third beat is a medium beat, but for convenience sake it is assumed the third beat is a downbeat.) The second beat and the fourth beat are upbeats. In case of music of a triple meter, the first beat in a measure is a downbeat and the second beat and the third beat are upbeats. In case of music of a double meter, the first beat and the second beat in a measure are a downbeat and an upbeat, respectively.

Figure 10:
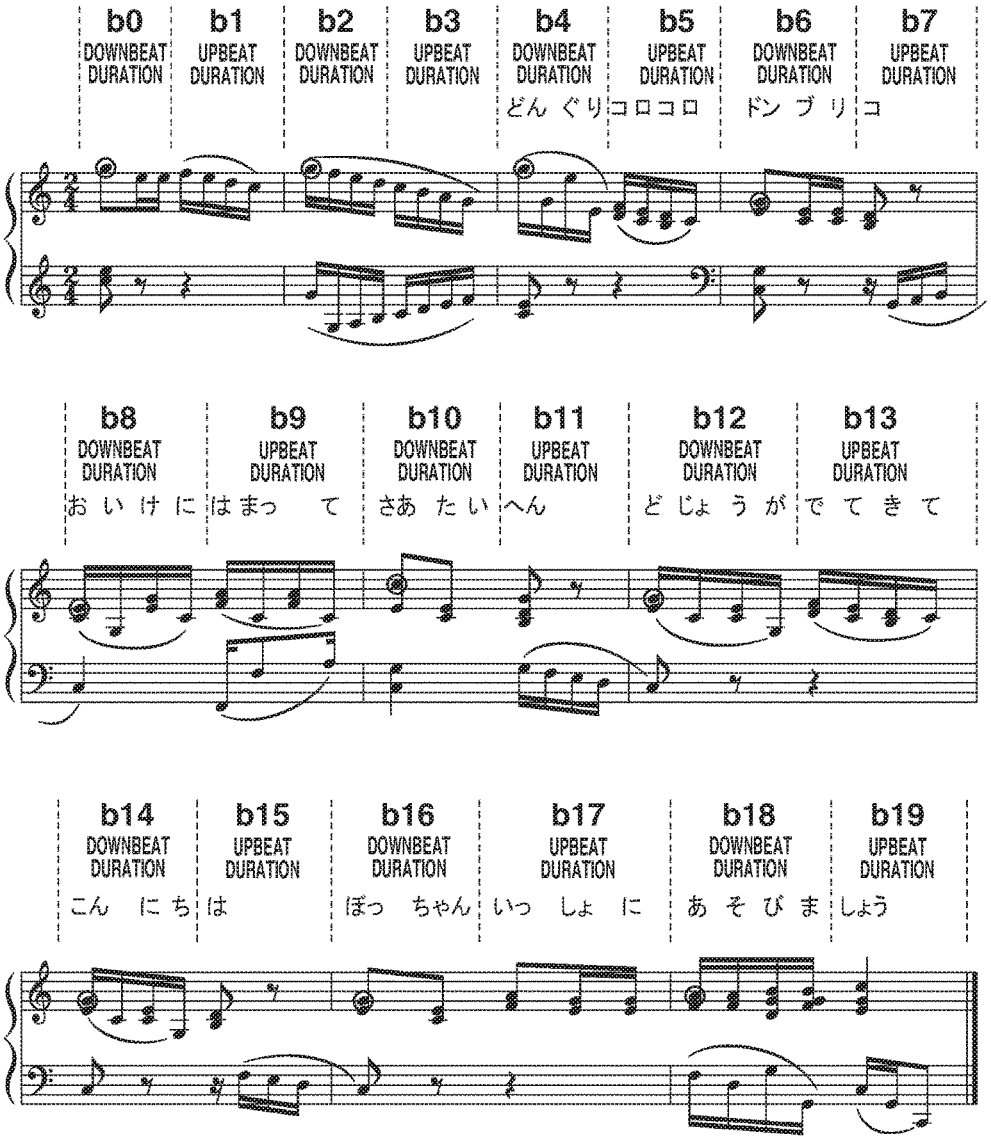
FIG. 10 is a view showing a part of a musical score of Japanese children's song of a two-four meter "Rolling Acorn" written by Nagayoshi Aoki, composed by Tadashi Yanada.

FIG. 10 is a view showing a part of an automatic playing music (a musical score of Japanese children's song of a two-four meter, "Rolling Acorn" written by Nagayoshi Aoki, composed by Tadashi Yanada). In the musical score, symbols from "b0" to "b19" express beat (downbeat and upbeat) durations. In the process at step S903 in FIG. 9, using the above information shown in FIG. 10 the CPU 201 calculates a duration (a time length) in unit of Tick Time of a beat in each measure of the automatic playing music. For instance, the downbeat duration "b0" at the first beat in the first measure is a duration from "0" to "479" in unit of Tick Time. The upbeat duration "b1" at the second beat in the first measure is a duration from "480" to "959" in unit of Tick Time. Similarly, the beat durations up to the fourth beat in the final measure are calculated.

With reference to the beat durations calculated at step S903, the CPU 201 designates the downbeat duration at the first beat in the first measure at step S904 and then successively increments the position of the downbeat at step S915 to repeatedly perform a series of processes at steps S905 to S913 every downbeat until it is determined that the last downbeat in the last measure is reached.

In the repeatedly performed processes at steps S905 to S913, the CPU 201 searches through the note-on events which are calculated and stored on the RAM 203 at step S902 to extract a note-on event which is made note on at the beginning (or within a Tick Time from the beginning) in the downbeat duration, as a candidate for a prior tone (step S905).

The CPU 201 judges at step S906 whether the candidate for a prior tone has been extracted at step S905.

When it is determined at step S906 that the candidate for a prior tone has not been extracted (NO at step S906), the CPU 201 determines that syncopation is generated and extracts the final tone in the just preceding upbeat duration as the candidate for a prior tone (step S907).

When it is determined at step S906 that the candidate for a prior tone has been extracted (YES at step S906), the CPU 201 skips over the process at step S907.

The CPU 201 judges whether the extracted candidate for a prior tone is a single tone (step S908).

When it is determined at step S908 that the extracted candidate for a prior tone is a single tone (YES at step S908), the CPU 201 employs the extracted candidate as the prior tone (step S909). In the example shown in FIG. 10, note-on events corresponding to the tones (surrounded with ○ such as the leading tone "G4" in the downbeat duration "b0", the leading tone "G4" in the downbeat duration "b2", and the leading tone "G4" in the downbeat duration "b4" are employed as the prior tone at step S909.

When it is determined at step S908 that the extracted candidate for a prior tone is not a single tone (NO at step S908), the CPU 201 judges at step S910 whether the extracted candidates for a prior tone are chord composing tones.

When it is determined at step S910 that the extracted candidates for a prior tone are chord composing tones (YES at step S910), the CPU 201 employs the tonic of the chord composing tones as the prior tone (step S911).

When it is determined at step S910 that the extracted candidates for a prior tone are not chord composing tones (NO at step S910), the CPU 201 employs the tone (hereinafter, the "highest pitch tone") of the highest pitch among the plural candidates (step S912). In the example shown in FIG. 10, note-on events corresponding to the tones (surrounded with ○ such as the tone "G3" in the downbeat duration "b6", the tone "E3" in the downbeat duration "b8", the tone "C4" in the downbeat duration "b10", the tone "G3" in the downbeat duration "b12", the tone "G3" in the downbeat duration "b14", the tone "G3" in the downbeat duration "b16", and the tone "A3" in the downbeat duration "b18" are employed as the prior tone at step S912.

After performing the process at step S909 and the process at step S911 or S912, the CPU 201 adds an entry of a key light-up controlling data-set Light Note [i] to the end of the key light-up controlling data having the data configuration shown in FIG. 4 stored in the RAM 203. Meanwhile, the CPU 201 calculates an event generating time of the note-on event of the prior tone employed in the processes at steps S909, S911 or S912 (step S902) and stores the calculated event generating time of the note-on event of the prior tone in the RAM 203. Further, the CPU 201 sets the event generating time stored in the RAM 203 as a value of Light On Time of the above entry. Furthermore, the CPU 201 sets a key number given to the note-on event of the prior tone employed in the processes at steps S909, S911 or S912 as the Light On Time value of the above entry (step S913).

The CPU 201 judges at step S914 whether the process has been performed up to the last downbeat in the last measure.

When it is determined NO at step S914, then the CPU 201 designates the next downbeat duration (step S915) and returns to the process at step S905.

When it is determined YES at step S914, then the CPU 201 finishes the automatic playing music reading process (step S704 in FIG. 7) shown in FIG. 9.

When the automatic playing music reading process has been performed as shown in FIG. 9, the automatic playing music data having the data format shown in FIG. 3 is expanded on the RAM 203 and the key light-up controlling data having the data format shown in FIG. 4 is generated. In the automatic playing music shown in FIG. 10, the key light-up controlling data corresponding to the note-on events of the tones surrounded with ○ is generated at positions of the beats.

Figure 11:
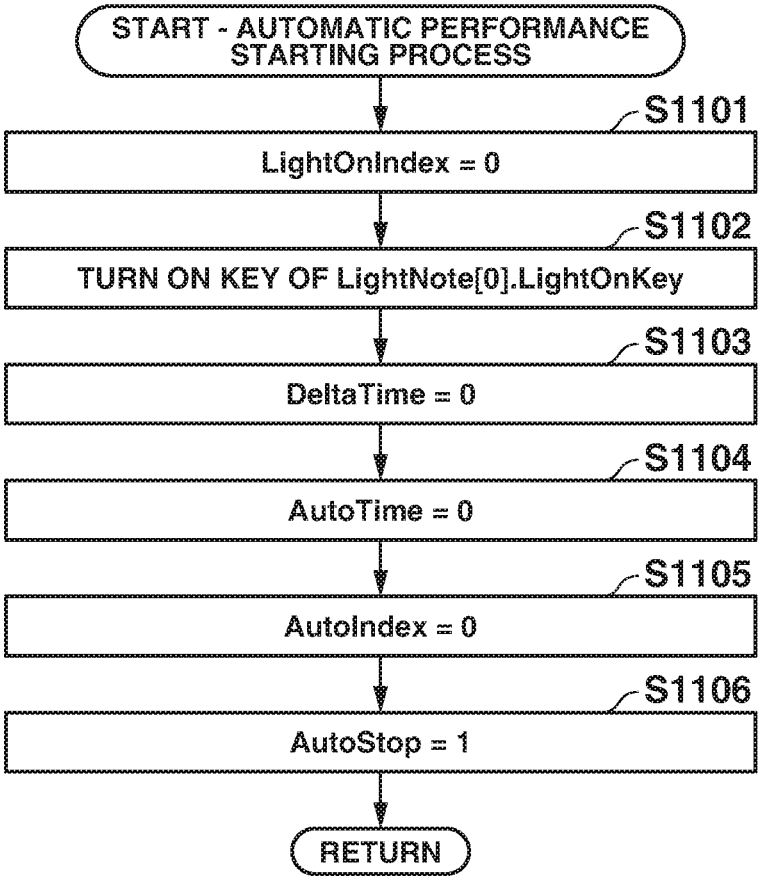
FIG. 11 is a flow chart of an example of an automatic performance starting process.

FIG. 11 is a flow chart of an example of the automatic performance starting process at step S706 in FIG. 7.

The CPU 201 initializes a value of a variable, Light On Index on the RAM 203 for designating "i" of the key light-up controlling data set, Light Note [i] ($1 \leq i \leq N-1$) (FIG. 4) (step S1101 in FIG. 11). Then, in the example shown in FIG. 4, the key light-up controlling data set, Light Note [Light On Index]=Light Note [0] will be referred to as the initial state.

The CPU 201 instructs the LED controller 207 (FIG. 2) to control the keyboard 101 to make LED turn on, which LED is disposed under the key of the number corresponding to the Light On Key value (=Light Note [0]. Light On Key) in the leading key light-up controlling data set Light Note [0] (FIG. 4) indicated by the Light On Index=0 (step S1102).

The CPU 201 initializes a value of a variable Delta Time on the RAM 203 to "0" (step S1103), thereby counting a relative time in unit of Tick Time from the starting time of the last event in the progress of the automatic performance.

Further, the CPU 201 initializes a value of a variable Auto Time on the RAM 203 to "0" (step S1104), thereby counting an elapsed time in unit of Tick Time from the beginning of the music in the progress of the automatic performance.

The CPU 201 initializes a value of a variable Auto Time on the RAM 203 to "0" (step S1105) to designate "i" of the performance data set the Delta Time [i] and the Event [i] ($1 \leq i \leq L-1$) in the track chunk 1 of the automatic playing music data (FIG. 3). Then, in the example shown in FIG. 3, the leading performance data set the Delta Time [0] and the Event [0] in the track chunk 1 will be referred to as the initial state.

Finally, the CPU 201 sets a variable Auto Stop on the RAM 203 to the initial value of "1" (stop) to give an instruction of stopping the automatic performance (step S1106). Thereafter, the CPU 201 finishes the automatic performance starting process (step S706 in FIG. 7) shown in FIG. 11.

Figure 12:
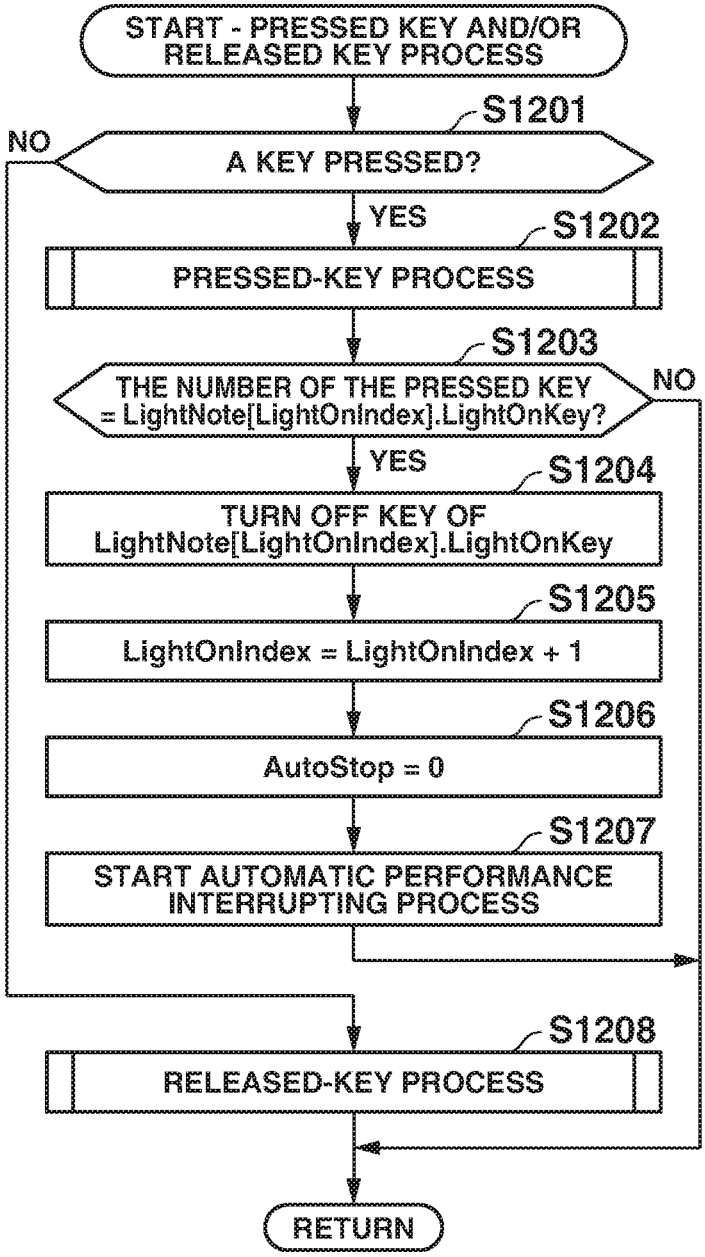
FIG. 12 is a flow chart of an example of a detailed pressed and/or released key process.

FIG. 12 is a flow chart of an example of the detailed pressed and/or released key process at step S506 in FIG. 5.

When the operation is interrupted by key scanner 206, the CPU 201 judges whether a key of the keyboard 101 has been pressed (step S1201).

When it is determined at step S1201 that a key of the keyboard 101 has been pressed (YES at step S1201), the CPU 201 performs a pressed-key process on the sound source LSI 1204 (FIG. 2) at step S1202. In the pressed-key process, a note-on instruction is given to the sound source LSI 1204, which instruction indicates the number (key number) of the pressed key and velocity of the pressed key. The key number of the pressed key and velocity of the pressed key are informed from the key scanner 206.

The CPU 201 judges whether the key number of the pressed key informed from the key scanner 206 is equivalent to a value of the Light On Key (=Light Note [Light On Index]. Light On Key) in the key light-up controlling data set Light Note [Light On Index] indicated by the value of the Light On Index stored in the RAM 203 (step S1203).

When it is determined NO at step S1203, the CPU 201 finishes the pressed and/or released key process (step S506 in FIG. 5) shown in FIG. 12.

When it is determined YES at step S1203, the CPU 201 instructs the LED controller 207 (FIG. 2) to control the keyboard 101 to make LED turn off, which LED is disposed under the key of the key number corresponding to the Light Note [Light On Index]. Light On Key (step S1204).

Further the CPU 201 increments the value of the Light On Index by "+1" to refer to the key light-up controlling data (step S1205).

When the player has pressed the luminous or lighted up key, the CPU 201 resets the value of the Auto Stop to "0" to release the automatic performance from the resting state (step S1206).

Thereafter, the CPU 201 makes an automatic performance interruption to start an automatic performance interrupting process (shown in FIG. 13) (step S1207). After performing the automatic performance interrupting process, the CPU 201 finishes the pressed and/or released key process (step S506 in FIG. 5) shown in FIG. 12.

When it is determined at step S1201 that the key of the keyboard 101 has been released (NO at step S1201), the CPU 201 performs a released-key process on the sound source LSI 1204 (FIG. 2) at step S1208. In the released-key process, a note-on instruction is given to the sound source LSI 1204, which instruction indicates a key number and velocity of the released key which is informed from the key scanner 206.

Figure 13:
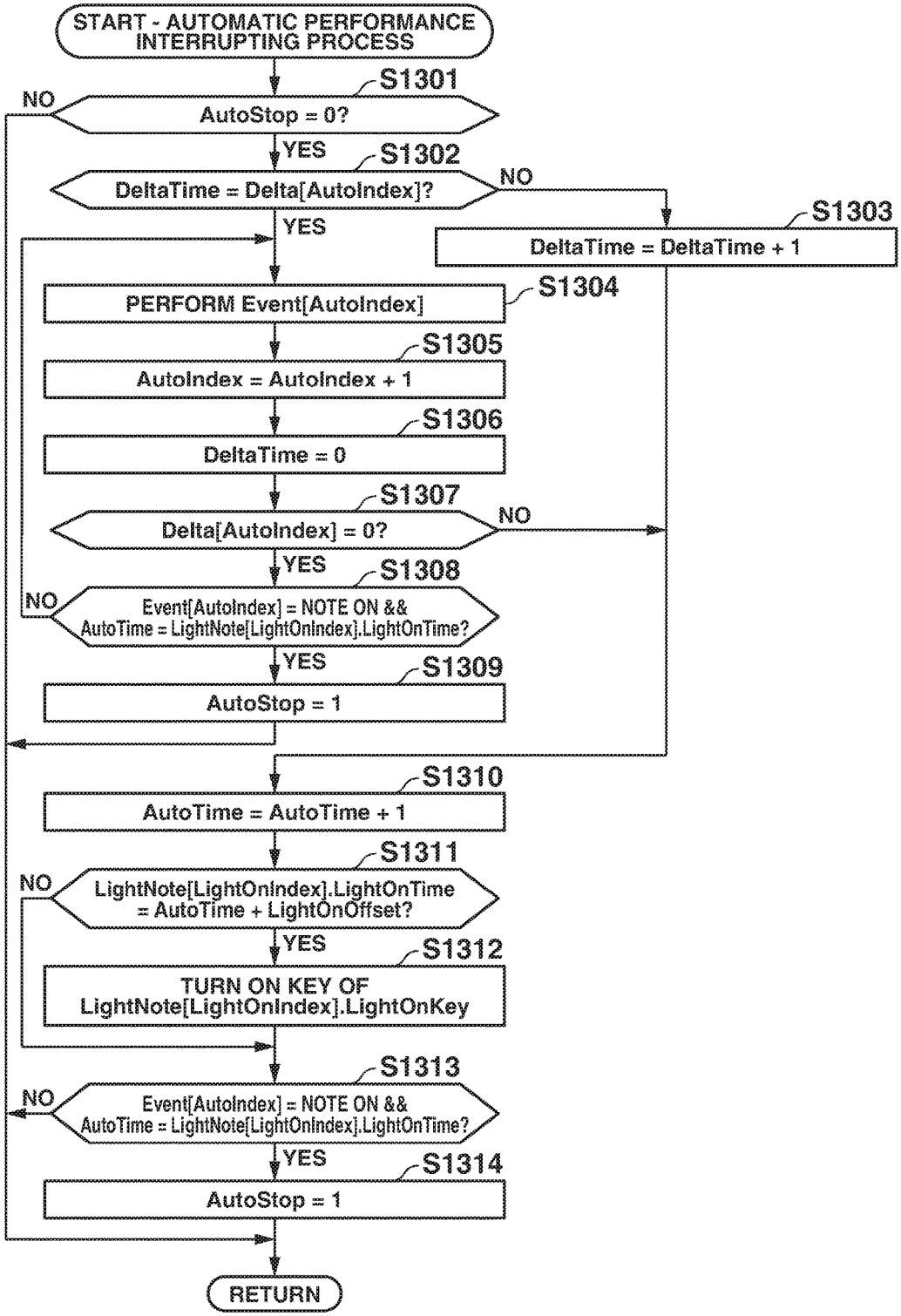
FIG. 13 is a flow chart of an example of a detailed automatic performance interrupting process.

FIG. 13 is a flow chart of an example of the detailed automatic performance interrupting process which is performed based on the interruption made at step S1207 in FIG. 12 or made every Tick Time [seconds] in the timer 210 (FIG. 2) (step S1208). The following process is performed on the performance data set of the track chunk 1 in the automatic playing music data shown in FIG. 3. In the example of FIG. 10 the process is shown which will be performed on the musical tone group for the right hand part.

The CPU 201 judges whether a value of the Auto Stop is "0", that is, judges whether no instruction has been given to stop the automatic performance (step S1301).

When it is determined at step S1301 that an instruction has been given to stop the automatic performance (NO at step S1301), the CPU 201 does not make the automatic performance progress and stops performing the automatic performance interrupting process at once.

When it is determined at step S1301 that the instruction has not been given to stop the automatic performance, that is, that an instruction has been given to continue the automatic performance (YES at step S1301), the CPU 201 judges whether a value of the Delta Time indicating a relative time from the generation of the previous event is equivalent to a waiting time Delta Time [Auto Index] in the performance data set to be performed, indicated by a value of the Auto Index (step S1302).

When it is determined NO at step S1302, the CPU 201 increments the value of the Delta Time indicating a relative time from the generation of the previous event by "+1", thereby making the time progress by 1 Tick Time corresponding to the current interruption (step S1303), and then advances to a process at step S1310, which will be described later.

When it is determined YES at step S1302, the CPU 201 performs the event Event [Auto Index] in the performance data set indicated by the value of the Auto Index (step S1304).

For example, if the event Event [Auto Index] to be performed at step S1304 is a note-on event, an instruction of generating a musical tone based on the key number and velocity designated by said note-on event will be given to the sound source LSI 1204. Meanwhile, if the event Event [Auto Index] is a note-off event, an instruction of stopping generation of a musical tone based on the key number and velocity designated by said note-off event will be given to the sound source LSI 1204 (FIG. 2).

Further, if the event Event [Auto Index] is a meta event designating lyrics data, an instruction of generating a voice of a pitch indicated by the just previously designated note-on event will be given to the voice synthesizing LSI 205 (FIG. 2). Meanwhile, at the time when the note-off event corresponding to the note-on event has been performed, an instruction to stop generating voice will be given to the voice synthesizing LSI 205. In this fashion, voices will be generated based on text data of lyrics represented on the music score in the example illustrated in FIG. 10.

Further the CPU 201 increments the value of the Auto Index by "+1" to refer to the performance data set (step S1305).

The CPU 201 resets the value of the Delta Time indicating a relative time from the generation of the currently performed event to "0" (step S1306).

The CPU 201 judges whether the waiting time Delta Time [Auto Index] in the performance data set to be performed, indicated by the value of the Auto Index is "0", that is, whether the performance data set is the event which is performed at the same time as the current event is performed (step S1307).

When it is determined NO at step S1307, the CPU 201 advances to a process at step 1310 to be described later.

When it is determined YES at step S1307, the CPU 201 judges whether the event Event [Auto Index] in the performance data set to be performed next, indicated by the value of the Auto Index is a note-on event and a value of the Auto Time indicating a current elapsed time from the starting time of the automatic performance has reached a value (=Light Note [Light On Index]. Light On Time) of the Light On Time in the key light-on controlling data set Light Note [Light On Index] indicated by the value of the Light On Index (step S1308).

When it is determined NO at step S1308, the CPU 201 returns to the process at step S1304, and executes the event Event [Auto Index] in the performance data set indicated by the value of the Auto Index to be performed next together with the event to be currently performed simultaneously. The CPU 201 executes the processes at steps S1304 to S1308 repeatedly by the number of times, for which the process is currently performed simultaneously. The above sequence will be executed when plural note-on events are sounding at the same timing such as a chord.

When it is determined YES at step S1308, the CPU 201 sets the value of the Auto Stop to "1" (step S1309) to stop the automatic performance until the player presses a next luminous key of the keyboard 101. Thereafter, the CPU 201 finishes the automatic performance interrupting process shown in FIG. 13. The sequence will be executed after the note-off events are performed to cease a sound of a tone which is generating just before note-on events of the prior tones of "b2", "b4", "b6", "b10", "b14", and "b18" in the musical score of FIG. 10 are performed.

After performing the process at step S1303 or S1307, the CPU 201 increments the value of the Auto Time indicating the elapsed time from the starting time of the automatic performance by "+1" for preparing the following automatic playing process, and makes the time progress by 1 Tick Time corresponding to the current interruption (step S1310).

Further the CPU 201 judges whether a value which is obtained by adding a predetermined offset value of Light On Offset to the value of the Auto Time has reached a value (=Light Note [Light On Index]. Light On Time) of the Light On Time in the next key light-on controlling data set Light Note [Light On Index] indicated by the value of the Light On Index (step S1311). In other words, the CPU 201 judges whether the time has fallen within a certain range of time from the time when the key is to be made luminous.

When it is determined YES at step S1311, the CPU 201 instructs the LED controller 207 (FIG. 2) to control the keyboard 101 to make LED turn on, which LED is disposed under the key of the key number corresponding to the Light On Key value in the key light-up controlling data set Light Note [Light On Index] (FIG. 4) indicated by the value of the Light On Index (step S1312).

When it is determined NO at step S1311, the CPU 201 skips over the process at step S1312.

Finally, similarly to the process at step S1308, the CPU 201 judges whether the event Event [Auto Index] in the performance data to be performed next, indicated by the value of the Auto Index is a note-on event and a value of the Auto Time indicating a next elapsed time from the starting time of the automatic performance has reached a value of the Light On Time in the key light-on controlling data set Light Note [Light On Index] indicated by the value of the Light On Index (step S1313).

When it is determined YES at step S1313, the CPU 201 sets the value of the Auto Stop to "1" (step S1314) to stop the automatic performance until the player presses a next luminous key of the keyboard 101. The sequence will be executed, when there is an interval in which nothing is performed between the continuous note-on events, for instance, when there is a rest. In the musical score of FIG. 10, the sequence will be executed when the automatic performance interrupting process (FIG. 13) has been executed just before (1 Tick Time) note-on events of the prior tones of "b8", "b12", and "b16" are performed.

When it is determined NO at step S1313, the CPU 201 skips over the process at step S1314.

Thereafter, the CPU 201 finishes the automatic performance interrupting process shown in FIG. 13.

While the pressed and/or released key process shown in FIG. 12 and the automatic performance interrupting process shown in FIG. 13 are performed, keys of the keyboard 101 are made luminous or lighted up, corresponding to the prior tones decided successively from the beginning of the automatic playing music data, whereby the player is allowed to perform interactive operation, pressing such luminous or lighted up keys successively to play the music.

As explained with reference to the process at step S1304, it is possible to make the voice synthesizing LSI 205 generate singing voices with pitches and durations corresponding to note-on events and note-off events, singing a song lyric given by a meta event in the track chunk 1, in accordance with the note-on event data and the note-off event data which are supplied to the sound source LSI 204 to accompaniment of the automatic performance of automatic playing music data. In this case, when the player presses a prior tone or a luminous key of the keyboard 101, the next key is made luminous, the sound source LSI 204 is made the automatic performance advance up to just before the next prior tone, and the voice synthesizing LSI 205 is also made to generate the singing voice.

In the above description, the automatic performance interrupting process has been explained, which is performed on only the track chunk 1 concerning the controlling process for lighting up a key of the keyboard 101 among the automatic playing music data shown in FIG. 3. But a general automatic performance interrupting process is performed on the track chunk 2. That is, the automatic performance interrupting process is performed on the track chunk 2 based on the interruption made by the timer 210 without performing the process at step S1309, and the processes at steps S1301 to S1308 in FIG. 13. An automatic performance stop/advance controlling process on the track chuck 2 which corresponds to the process of step S1301 in FIG. 13 will be performed in synchronism with the process of step S1301 performed on the track chuck 1 when the value of the Auto Stop is judged.

The embodiments of the invention which are applied on the electronic keyboard instrument have been described. The present invention can be applied on other electronic musical instruments such as electronic wind instruments. For instance, when the present invention is applied on the electronic wind instrument, the controlling processes at steps S908, S910 to S912 in FIG. 9 are not required to decide chord composing tones. It will be enough that a single prior tone is decided at step S909.

Although specific configurations of the invention have been described in the foregoing detailed description, it will be understood that the invention is not limited to the particular embodiments described herein, but modifications and rearrangements may be made to the disclosed embodiments while remaining within the scope of the invention as defined by the following claims. It is intended to include all such modifications and rearrangements in the following claims and their equivalents.

What is claimed is:

1. An electronic musical instrument comprising:

plural operators that specify different pitches of a musical tone indicated by music data, respectively, wherein the music data has plural sections containing at least a first section of a time length and a second section of a time length, the second section following the first section, and wherein plural pitches are included in both of the first section and the second section; and a processor that executes:

displaying an identifier for identifying one pitch among the plural pitches included in the first section, allowing a player to operate the operator corresponding to the pitch identified in the first section by the identifier; and playing back musical tones corresponding to pitches of a downbeat timing and an upbeat timing in the first section in response to the operation of the operator at the downbeat timing by the player, even if there is no operation at the upbeat timing by the player, up to a pitch among the plural pitches included in the second section, whereby the processor executes an automatic playing back of the music data.

2. The electronic musical instrument according to claim 1, wherein:

the sections include at least one section duration of one meter; and it is possible to make a section duration of the first section and a section duration of the second section equivalent to each other or different from other.

3. The electronic musical instrument according to claim 1, wherein the processor decides a prior tone in each section to allow the player to designate the aforesaid prior tone.

4. The electronic musical instrument according to claim 1, wherein the processor decides a pitch as a prior tone at a downbeat timing in each section to allow the player to designate the aforesaid prior tone.

5. The electronic musical instrument according to claim 4, wherein, when syncopation is generated at the downbeat timing in any one of the sections, the processor decides a last tone in a section before said any one of the sections as the prior tone in said any one of the sections.

6. The electronic musical instrument according to claim 1, wherein the processor specifies chord composing tones based on music data of the music, and when the chord composing tones have been specified, the processor further decides as the prior tone one tone having a tone duration different from other among the specified chord composing tones.

7. The electronic musical instrument according to claim 5, wherein, when the chord composing tones have not been specified, the processor decides a tone having a highest pitch in the section as the prior tone.

8. The electronic musical instrument according to claim 1, wherein the plural operators are composed of plural white keys and black keys of a keyboard, and the processor makes either key of the white keys and the black keys of the keyboard lighted up.

9. The electronic musical instrument according to claim 1, wherein the processor outputs voices in accordance with lyrics of the music in the automatic playing back of the music data.

10. An electronic musical instrument comprising:

plural operators that specify different pitches of a musical tone indicated in music data, respectively, wherein the music data has plural sections containing at least a first section and a second section which follows the first section, and wherein plural pitches are included in both of the first section and the second section; and a processor which executes:

displaying a prior tone of the first section indicated by one pitch among plural pitches contained in the first section, thereby allowing a player to designate the aforesaid prior tone;

playing back musical tones of the pitch corresponding to the prior tone of the first section and at least one pitch following the prior tone in the first section every time one of the plural operators corresponding to the prior tone is designated by the player, even if there is no subsequent operation by the player of one of the plural operators corresponding to the at least one pitch following the pitch corresponding to the prior tone in the first section; and keeping the musical tones sounding up to a tone before a prior tone of the second section indicated by one pitch among plural pitches contained in the second section, whereby the processor executes an automatic playing back of the music data.

11. A method of controlling operation of an electronic musical instrument by a computer, wherein the electronic musical instrument has plural operators that specify different pitches of a musical tone indicated by music data, respectively; the music data has plural sections containing at least a first section of a time length and a second section of a time length, the second section following the first section; and plural pitches are included in both of the first section and the second section; and the method comprises, with the computer:

displaying a prior tone of the first section indicated by one pitch among plural pitches contained in the first section, thereby allowing a player to designate the aforesaid prior tone;

playing back musical tones of the pitch corresponding to the prior tone of the first section and at least one pitch following the prior tone in the first section every time one of the plural operators corresponding to the prior tone is designated by the player, even if there is no subsequent operation by the player of one of the plural operators corresponding to the at least one pitch following pitch corresponding to the prior tone in the first section; and keeping the musical tones sounding up to a tone before a prior tone of the second section indicated by one pitch among plural pitches contained in the second section, whereby the computer executes an automatic playing back of the music data.

12. A non-transitory recording medium with a program stored thereon, executable by a computer that controls an electronic musical instrument, wherein the electronic musical instrument has plural operators that specify different pitches of a musical tone indicated by music data, respectively; the music data has plural sections containing at least a first section of a time length and a second section of a time length, the second section following the first section; and plural pitches are included in both of the first section and the second section; and the program is executable by the computer to cause the computer to execute functions comprising:

displaying a prior tone of the first section indicated by one pitch among plural pitches contained in the first section, thereby allowing a player to designate the aforesaid prior tone;

playing back musical tones of the pitch corresponding to the prior tone of the first section and at least one pitch following the prior tone in the first section every time one of the plural operators corresponding to the prior tone is designated by the player, even if there is no subsequent operation by the player of one of the plural operators corresponding to the at least one pitch following pitch corresponding to the prior tone in the first section; and keeping the musical tones sounding up to a tone before a prior tone of the second section indicated by one pitch among plural pitches contained in the second section, whereby the computer executes an automatic playing back of the music data.

* * * * *